United States Patent [19]

Jones

[11] Patent Number: 4,929,205

[45] Date of Patent: May 29, 1990

[54] LEG IMMOBILIZER-DRAG FOR TRAINING SWIMMERS

[76] Inventor: Elene K. Jones, 1571 Hillview Dr., Sarasota, Fla. 33579

[21] Appl. No.: 254,720

[22] Filed: Oct. 7, 1988

[51] Int. Cl.[5] ..... A63C 5/00

[52] U.S. Cl. ..... 441/60; 441/88; 441/55; 272/1 B

[58] Field of Search ..... 441/55, 60, 88; 272/1 B; D21/237, 238

[56] References Cited

U.S. PATENT DOCUMENTS

| | | | |
|---|---|---|---|
| 1,511,312 | 10/1924 | Alastalo . | |
| 3,427,022 | 2/1969 | Ward . | |
| 3,771,182 | 11/1973 | Lind | 441/88 |
| 4,079,932 | 3/1978 | Schuetz | 272/75 |
| 4,227,273 | 10/1980 | Lucciola . | |
| 4,293,126 | 10/1981 | Havens | 272/119 |
| 4,300,759 | 11/1981 | Caplan | 272/116 |
| 4,362,518 | 12/1982 | Boissiere | 441/60 |
| 4,379,704 | 4/1983 | Rademacher | 441/88 |

FOREIGN PATENT DOCUMENTS

| | | | |
|---|---|---|---|
| 441789 | 3/1927 | Fed. Rep. of Germany | 441/88 |
| 1599666 | 10/1981 | United Kingdom | 441/60 |

*Primary Examiner*—Sherman D. Basinger
*Assistant Examiner*—Stephen P. Avila
*Attorney, Agent, or Firm*—Fleit, Jacobson, Cohn, Price, Holman & Stern

[57] ABSTRACT

A pair of laterally spaced generally cylindrical hollow bodies are provided and connected by a thin connecting flange assembly extending there between and lying along a plane containing the longitudinal center axis of said bodies. One pair of corresponding end walls of the bodies include ingress and egress ports formed therein having removable fluid tight closures engaged therewith whereby the interiors of the bodies may be partially or completely filled with liquid to vary the buoyancy of the bodies. Adjacent portions of the bodies, on opposite sides of the connecting flange assembly, defined outwardly opening channels in which the adjacent portions of the thighs of a swimmer may be seated with the swimmer's thighs seated primarily against the bodies rather than being primarily seated against the connecting flange assembly.

8 Claims, 1 Drawing Sheet

LEG IMMOBILIZER-DRAG FOR TRAINING SWIMMERS

BACKGROUND OF THE INVENTION

1. Field of the Invention

An adjustable buoyancy structure is provided to be held between the legs of a practicing swimmer in order to assist in developing arm muscles while swimming. The drag also is beneficial to swimmers practicing the butterfly, backstroke, breaststroke and freestyle swimming stroke and functions to substantially immobilize the legs of a swimmer against movement relative to each other.

2. Description of Related Art

Various different forms of swimming practice aides and other devices including some of the general structural and operational features of the instant invention heretofore have been provided.

Examples of these previously known structures are disclosed in U.S. Pat. Nos. 1,511,312; 3,427,022; 4,079,932; 4,227,273; 4,293,126; 4,300,759; 4,362,518 and 4,397,704.

U.S. Pat. No. 4,362,518 of the above-noted patents is pertinent to the instant invention in that it discloses a pair of elongated opposite side and laterally spaced portions interconnected by a relatively thin central portion extending between and interconnecting the opposite side portions. However, the "kick board" disclosed in U.S. Pat. No. 4,362,518 is not constructed in a manner whereby it functions as a relative leg movement immobilizer which is substantially 100% effective.

SUMMARY OF THE INVENTION

The training leg immobilizing drag of the instant invention incorporates a pair of side-by-side, elongated and laterally spaced apart substantially rigid bodies joined by a thin connecting flange assembly extending therebetween. The bodies are streamlined in shape for longitudinal movement through water with little resistance and the connecting flange assembly is at least substantially rigid and at least substantially rigid with the bodies. Further, the bodies include portion adjacent the connecting flange assembly of cross-sectional shape such that when the drag is held between closely adjacent thighs of a swimmer, with the bodies extending along the thighs and the connecting flange assembly passing between the thighs, the adjacent portions of the thighs are primarily seated against the aforementioned adjacent body portions as opposed to being primarily seated against opposite sides of the connecting flange assembly. In this manner, relative angular displacement of the thighs of a swimmer is prevented due to the adjacent sides of the swimmer's thighs being seated within opposite side and outwardly opening channel areas defined by the rigid drag.

The main object of this invention is to provide a drag for use by swimmers in training in order to substantially immobilize the thighs of a swimmer against relative angular displacement.

Another object of this invention is to provide a drag in accordance with a preceding object and which will be comfortable to use.

Yet another object of this invention is to provide a drag constructed in a manner enabling it to be used in conjunction with swimmers having different size thighs.

Another important object of this invention is to provide a drag in accordance with the preceding objects and whose buoyancy may be varied.

Yet another object of this invention is to provide a drag which also may be used as a "kick board".

A final object of this invention to be specifically enumerated herein is to provide a drag in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
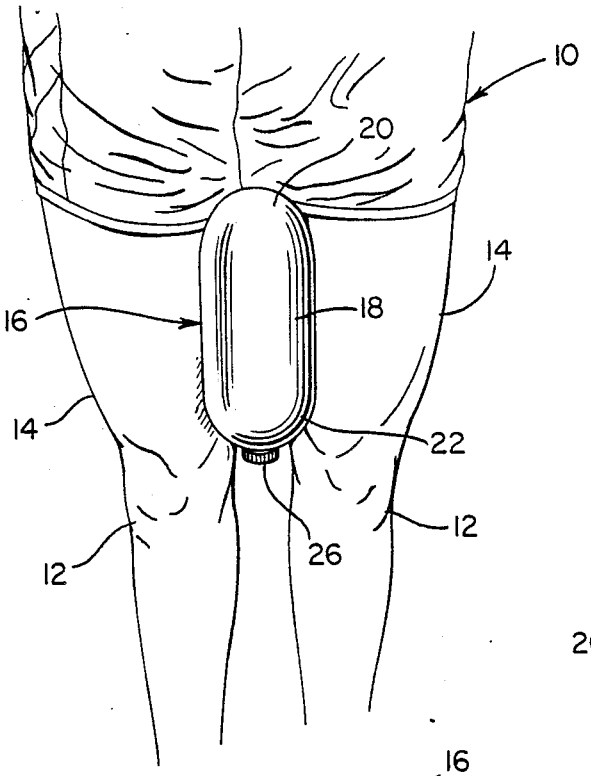
FIG. 1 is a fragmentary front elevational view of the lower body and upper leg portion of a swimmer with the drag of the instant invention illustrated disposed between the thighs of the swimmer.
Figure 2:
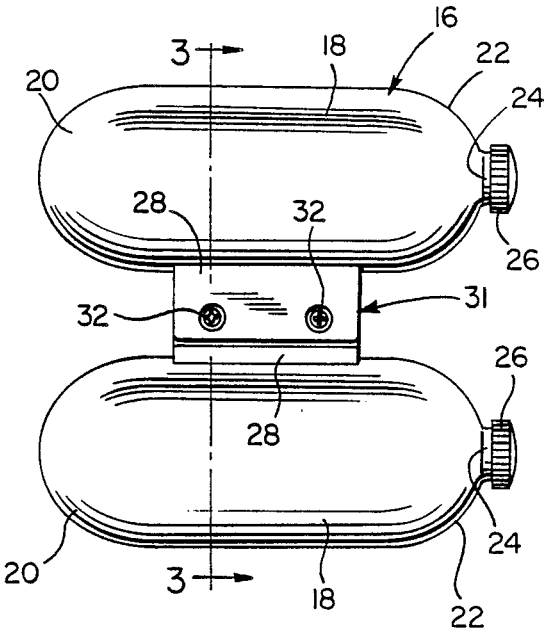
FIG. 2 is an enlarged plan view of the drags.

Referring now more specifically to the drawings, the numeral 10 generally designates a swimmer having a pair of legs 12 including thighs 14.

The drag of the instant invention is referred to in general by the reference numeral 16 and is disposed between the thighs 14 and held therebetween by the swimmer 10 when practicing.

The drag 16 includes a pair of side-by-side elongated and laterally spaced apart substantially rigid bodies 18 which may be constructed of plastic and manufactured by a molding process. Each of the bodies 18 is substantially cylindrical in configuration and includes a pair of hemispherical opposite end walls 20 and 22, the end walls 22 including ingress and egress opening defining tubular necks 24 and having fluid tight closures 26 removably supported therefrom.

The bodies 18 each include an integral radially outwardly projecting and longitudinally extending flange 28 supported therefrom and each flange 28 is rabbetted as at 30. The rabbetted portions of the flanges 28 are overlap engaged with each other and removably secured together through the utilization of recessed and removable fasteners 32 in order to form a connecting flange assembly 31 rigidly interconnecting the bodies 18. Further, it will be noted that each body 18 and flange 28 comprises an integrally formed structure and that each of the structures is identically formed and may be produced from the same mold.

Figure 3:
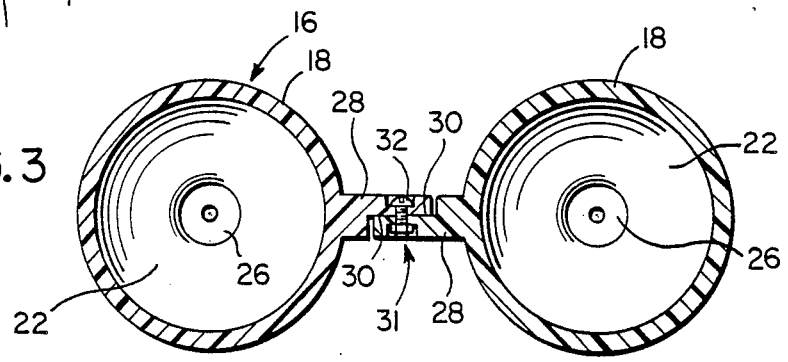
FIG. 3 is a further enlarged transverse sectional view taken substantially upon the plane indicated by the section line 3—3 of FIG. 3.
Figure 4:
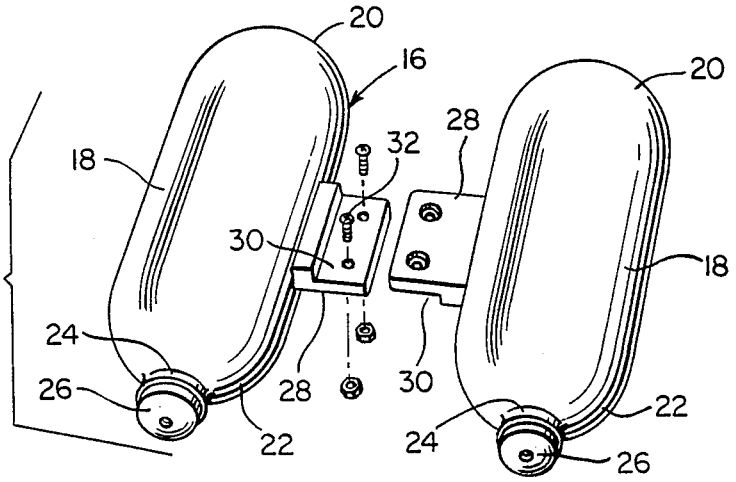
FIG. 4 is an exploded perspective view of the drag illustrating the manner in which two identical mold formed components may be utilized and removably secured together in order to form the completed drag.

The bodies 18 are between 3 and 5 inches in outside diameter and are spaced apart, when the flanges 28 are joined in the manner illustrated in FIG. 3, such that the thighs of substantially any sized person may clamp the drag 16 therebetween with the thighs 14 primarily seated against outwardly divergent surfaces of the bodies 18 on opposite sides of the flanges 30 as opposed to being primarily seated against the flanges 28 themselves. In this manner, the thighs 14 are substantially immobilized against relative angular displacement as long as the drag 16 is clamped in position between the thighs 14.

The drag 16 is quite buoyant when the bodies 18 are empty of liquid, but the closures 26 may be removed and the bodies 18 may be partially or fully filled with liquid such as water in order to reduce or eliminate the buoyancy of the drag 16.

The drag 16 is preferably constructed of hard plastic having a smooth outer surface. In this manner, substantially all relative angulation of the thighs 14 is prevented and the drag 16 will not scratch or abrasively rub the thighs 14. In addition, the plastic of which the drag 16 is formed will have resistance to ultra-violet rays and chlorine.

The foregoing is considered as illustrative only of the principles of the invention. Further, since numerous modifications and changes may occur to those skilled in the art, it is not desired to limit the invention to the exact construction and operation as shown and described, and accordingly, all suitable modifications and equivalents may be resorted to, falling within the scope of the invention.

I claim:

1. A training leg immobilizing drag for swimmers, said drag including a pair of side-by-side elongated and laterally spaced apart substantially rigid bodies joined by a thin connecting flange assembly extending therebetween, said bodies being streamlined in shape for longitudinal movement through water with little resistance, said connecting flange assembly being at least substantially rigid and at least substantially rigid with said bodies, said bodies including portions adjacent said connecting flange assembly of a cross sectional shape such that when said drag is held between closely adjacent thighs of a swimmer, with said bodies extending along said thighs and said connecting flange assembly passing between said thighs, the adjacent portions of said thighs are primarily seated against said adjacent portions of said bodies on opposite sides of said connecting flange assembly as opposed to being primarily seated against said connecting flange assembly, said bodies being hollow and including fluid ingress and egress ports having fluid tight closures removably associated therewith, said bodies including a pair of corresponding end walls and said ports being formed in said corresponding end walls of said bodies.

2. The drag of claim 1 wherein said bodies are generally cylindrical in shape and said connecting flange assembly is disposed in a plane containing the longitudinal center axis of said bodies.

3. The drag of claim 2 wherein said bodies are between three and five inches in diameter.

4. A training leg immobilizing drag for swimmers, said drag including a pair of side-by-side elongated and laterally spaced apart substantially rigid bodies joined by a thin connecting flange assembly extending therebetween, said bodies being streamlined in shape for longitudinal movement through water with little resistance, said connecting flange assembly being at least substantially rigid and at least substantially rigid with said bodies, said bodies including portions adjacent said connecting flange assembly of a cross sectional shape such that when said darg is held between closely adjacent thighs of a swimmer, with said bodies extending along said thighs and said connecting flange assembly passing between said thighs, the adjacent portions of said thighs are primarily seated against said adjacent poritons of said bodies on opposite sides o said connecting flange assembly as opposed to being primarily seated against said connecting flange assembly, said connecting flange assembly comprising a pair of flanges each fixed relative to a corresponding body and projecting outwardly therefrom toward the other body, said flanges being overlap engaged with each other and secured together.

5. The drag of claim 4 wherein said flanges are removably secured together in overlapped relation.

6. The drag of claim 5 wherein the overlapped portions of said flanges are complimentary rabbetted.

7. The drag of claim 6 wherein each of said bodies and the corresponding flange comprise a one piece mold formed structure.

8. The drag of claim 7 wherein said structures are identically formed.

* * * * *